US005738157A

United States Patent [19]

Gaffney

[11] Patent Number: 5,738,157

[45] Date of Patent: Apr. 14, 1998

[54] GOLF CLUB HEAD COVER AND SHAFT PROTECTOR

[76] Inventor: John Gaffney, 4420 E. Osborn, Phoenix, Ariz. 85018

[21] Appl. No.: 729,639

[22] Filed: Oct. 21, 1996

[51] Int. Cl.[6] ..... A63B 57/00

[52] U.S. Cl. ..... 150/160; 206/315.2

[58] Field of Search ..... 150/154, 160; 473/282; 206/315.2, 315.3, 315.4

[56] References Cited

U.S. PATENT DOCUMENTS

| | | | |
|---|---|---|---|
| 3,727,659 | 4/1973 | Shuford | 150/160 |
| 3,831,652 | 8/1974 | Hyden et al. | 150/160 |
| 3,938,570 | 2/1976 | Stewart | 150/160 |
| 4,195,677 | 4/1980 | Hagg et al | 150/160 |
| 4,497,404 | 2/1985 | Lowrance | 150/160 X |
| 5,117,884 | 6/1992 | Diener et al. | 150/160 |
| 5,284,194 | 2/1994 | Gaffney . | |
| 5,437,320 | 8/1995 | Sung | 150/160 |
| 5,547,193 | 8/1996 | Sander | 150/160 X |
| 5,573,241 | 11/1996 | Anderson | 150/160 X |

*Primary Examiner*—Christopher J. McDonald
*Attorney, Agent, or Firm*—LaValle D. Ptak

[57] ABSTRACT

A golf club head cover for use with golf clubs having graphite shafts has a generally hollow, cylindrically shaped head cover for the head of a golf club. The head cover has a closed upper end and an open lower end. The head cover is made of a first member of a semi-cylindrical shape; and this member has an elongated shaft protector secured to it externally from the closed upper end and extending beyond the open lower end of the first member. The portion of the shaft protector which extends beyond the open bottom of the first member has closure elements on it for closing the shaft protector around a shaft of a golf club.

18 Claims, 2 Drawing Sheets

GOLF CLUB HEAD COVER AND SHAFT PROTECTOR

BACKGROUND

Padded covers have been used for a number of years to protect the heads of golf clubs from banging into one another when they are carried in a golf bag. Typically, these head covers are made of soft padded bulky material, and extend around the head and a relatively short distance over the end of the shaft where the shaft attaches to the head. These head covers are closed at the top end (when the club is in the bag) and are open at the lower end from which the shaft extends. The opening is relatively wide; and it permits easy placement of the cover on the club head and permits relatively easy removal of the cover from the club head when that particular club is desired for use in the play of the game of golf.

Head covers of the type described above have been considered adequate for golf clubs which employ steel shafts. The advent of graphite shafts, however, has created a need to protect the portion of the shaft which extends outwardly from the top of a golf bag against contact with the heads of uncovered clubs, or from contact with the shafts of adjacent clubs. Additional wear also is produced from the golf bag dividers rubbing against the shafts while the golf cart is bouncing along, or the bag shifts as a golfer walks. This produces a "rub ring" around the shaft. Graphite shafts are more prone to scratching and nicking than metal shafts; and most golfers desire to reduce the potential for marring the finish of the graphite shafts of their clubs to as great an extent as possible.

Efforts to protect the exposed portions of graphite shafts from damage, when clubs are being transported or stored in a golf bag, have resulted in a modification of the golf club head cover by sewing a "knit sock" into the opening at the bottom of the head cover. Such a sock extends downwardly from the head cover opening, and terminates in a slightly enlarged end for the ingress and egress of a golf club head and shaft. Essentially, this "sock" is an elongated open-ended tube, the upper end of which is secured all around the bottom end of the head cover. To provide the necessary amount of protection without excess bulk, the sock has to have a relatively small internal diameter in its relaxed position. This effectively is provided by means of elongated ribs of the type employed in socks for personal wear.

While such knit sock-like shaft covers, attached to the head cover, theoretically provide the desired protection, a number of disadvantages exist. One of the major problems is that it is difficult to insert a club into the combined sock and head cover for storage, since the club head must be inserted through the open lower end of the sock. Then the entire unit must be stretched and pulled downwardly until the club head is secured in the upper end of the head cover. The sock then must be pulled down around the shaft; so that the golf club may be stored in the golf bag.

Frequently, when the golf club is dropped into the golf bag, the bottom end of the sock shaft protector catches the edge of the bag or catches dividers across the opening in the bag, and is pushed upwardly toward the bottom end of the head cover. This is inherent with the material out of which such shaft protector "socks" must be made, since they need to be very flexible in order to permit the passage of a golf club head through them into or out of the head cover. Whenever the "sock", however, is pushed up from its lowermost position it is possible to expose a part of the graphite shaft above the lip of the golf bag, thereby subjecting the shaft to possible scratching and marring.

Another problem which exists with "sock" type head covers is that the knit socks wear out rapidly. This is a result of the friction encountered when the head cover is placed on the head of a golf club and is removed from the head of a golf club.

Another disadvantage of the "sock" type shaft protectors, described above, is that since the "sock" is attached to the open end of the head cover, the sock tends to pull the cover to one side or the other. This spoils the "balanced" look, which otherwise is attained by head covers which do not have this additional "sock" shaft protector attached to them. While this might be considered a minor disadvantage, embroidered logos frequently are put on the head covers to promote a particular golf club or other products; and distortion or interference with the ideal appearance of embroidered head covers is considered unacceptable.

An additional disadvantage of the "sock" type head covers is that if one is dropped on the ground, the golfer must bend over to pick it up, since the sock prevents the end of a golf club from being inserted into the bottom end of the cover to lift it from the ground. In contrast, a standard head cover, not having a shaft protector sleeve or "sock" on it, easily may be lifted by inserting the head of a club into it without requiring the golfer to bend over to pick up the cover.

In an effort to overcome the disadvantages of the "sock" type shaft protectors, a shaft protector employing a rigid hollow plastic sleeve, with an open-ended sock at its top end, is disclosed in the U.S. patent to Lowrance U.S. Pat. No. 4,497,404. In the device disclosed in the Lowrance patent, a golf club is inserted shaft downwardly through the open-ended sock, which ultimately then covers the head of the golf club when the shaft and club head are fully inserted into the Lowrance device. Because the top of the "sock" part, which covers the golf club head, must be open, the head cover can slip downwardly off the head without providing the protection to the head which is desired. This patent, however, does overcome the "bunching" problem which is inherently present in the standard "sock" or sleeve type shaft protectors.

Another approach which overcomes the disadvantages of the prior art devices described above is disclosed in the U.S. patent to Gaffhey U.S. Pat. No. 5,284,194. In the device of Gaffhey, a generally standard golf club head cover has a closed upper end and an open lower end. An elongated shaft protector, made out of flexible but relatively stiff material, is secured to the inside of the head cover at a point intermediate the upper and lower ends. The shaft protector extends outwardly through the open lower end of the head cover and downwardly along the shaft of a golf club inserted into the cover. The shaft protector portion is an elongated tapered element, which has mating closures along the opposite edges. When the shaft protector is open, the golf club head easily is inserted into the head cover in a conventional manner. The shaft then is placed between the open edges in the shaft protector. One the shaft is in place, the shaft protector is closed over the shaft to hold the head cover and the shaft protector on the golf club as a unit. Because the shaft protector is attached to the inside of the cylindrical golf club head cover, the head cover has the appearance of "floating" with respect to the shaft protector part of the assembly.

A disadvantage which exists with all of the golf club head and shaft protectors described above, however, is the fact that the head cover portion of all of these devices generally is made of soft padded bulky material, or, as in the case of the device of Lowrance, is a soft elastic "sock-like" material. As noted above, embroidered logos or other indicia frequently are placed on these head covers to promote a particular golf club or other products. When embroidered designs are placed on such soft padded materials, the nature of the material itself frequently limits the details which may be employed in the design, since the softness of the material tends to somewhat distort the embroidered design.

It is desirable to provide a golf club head and shaft cover which includes all of the advantages present in the device disclosed in the Gaffhey patent U.S. Pat. No. 5,284,194 and which further provides an enhanced surface for the placement of embroidered designs, advertisements, or the like.

SUMMARY OF THE INVENTION

It is an object of this invention to provide an improved golf club head cover.

It is another object of this invention to provide an improved golf club head cover with a shaft protector sleeve on it.

It is an additional object of this invention to provide an improved golf club head cover and shaft protector as a unitary device to facilitate removal of a golf club from the device and to facilitate insertion of a golf club into the device.

It is a further object of this invention to provide an improved combined golf club head cover and shaft protector designed in a manner which further enhances the placement of embroidered designs and advertisements on the golf club head cover and shaft protector.

In a preferred embodiment of the invention, a golf club head cover is constructed as a generally hollow, cylindrically shaped cover for the head of a golf club. The head cover itself comprises a first member with first and second edges and with a closed upper end and an open lower end. An elongated shaft protector made of flexible material has first and second edges secured respectively to the first member of the head cover. The shaft protector extends downwardly beyond the open lower end of the first member of the head cover a predetermined distance, and is attached to the outside of the first member at its upper end adjacent the closed upper end. When a golf club is inserted into the golf club head cover, the portion of the shaft protector which extends below the open lower end of the first member is provided with a closure to close it around the shaft of a golf club inserted into the combined golf club head cover and shaft protector.

DETAILED DESCRIPTION

Reference now should be made to the drawings, in which the same reference numbers are used throughout the different figures to designate the same components. In addition, the subject matter of U.S. Pat. No. 5,284,194 is incorporated herein by reference.

Figure 1:
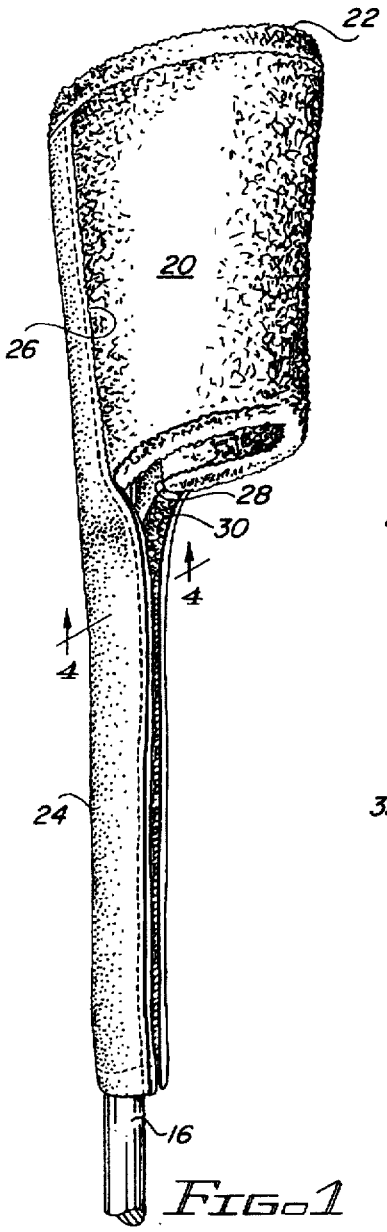
FIG. 1 is a perspective view of a preferred embodiment of the invention shown in a position of use.

FIG. 1 is a bottom perspective view of a preferred embodiment of the invention. This figure shows a combined golf club head cover and shaft protector comprising a head cover including a first part or upper portion in the form of a semi-cylindrically shaped member 20. The member 20 has first and second edges 26 and 28, which are attached to corresponding first and second edges 30 and 32 of an elongated shaft protector 24, as shown most clearly in FIGS. 2, 3 and 5.

The upper portion of the elongated shaft protector portion 24 (preferably in the form of an elongated rectangle or a slightly tapered trapezoid) completes a cylindrical head cover with the member 20. The member 20 constitutes a padded head cover formed of relatively high-pile "fuzzy" material to provide a bulky look and to provide padded protection for a golf club head. The top of the cylinder formed by the combination of the members 20 and 24 is enclosed by a padded circular disk 22, also preferably made of high-pile material. The portions 20 and 22 also further may be padded by means of foam inserts 34 and 36 (FIG. 6) to provide the padded protection and soft feel desirable in such a head cover.

The shaft protector portion 24 is made of material which is flexible but relatively stiff, particularly when compared to the soft knit sock shaft cover sleeves of prior art devices. The material 24 may be woven nylon material, leather, or other suitable, relatively stiff, flexible materials. The inner surface of the shaft protector portion 24 is covered with a soft insert 38, which is sewn into place in the center of the outer material 24, as illustrated most clearly in the exploded views of FIGS. 6 and 8.

Figure 2:
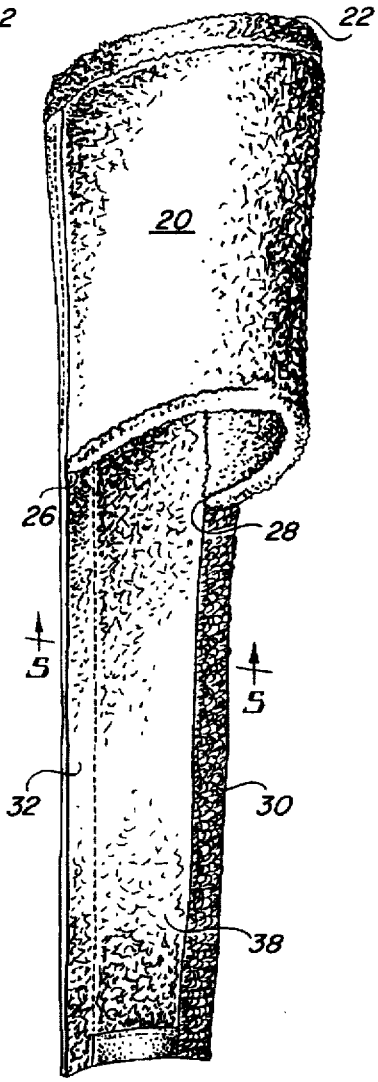
FIG. 2 is a perspective view of the embodiment shown in FIG. 1 illustrated in its open position.
Figure 6:
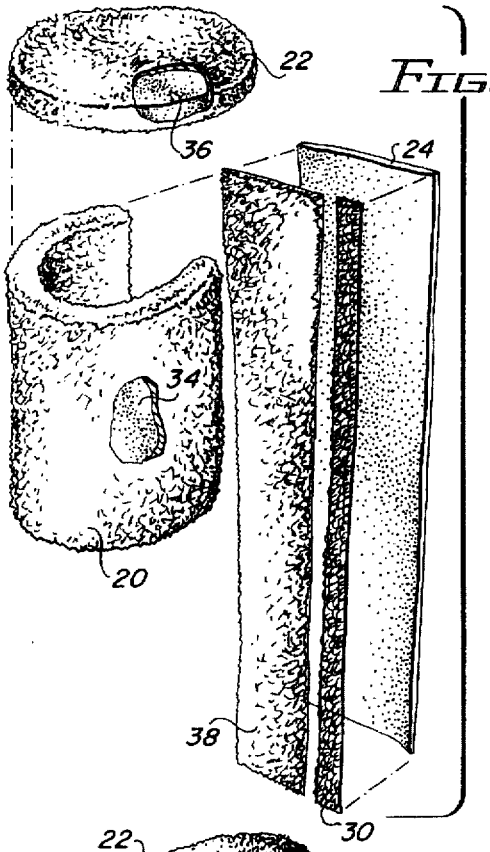
FIG. 6 is an exploded view of the various parts of the assembly shown in FIGS. 1, 2 and 3.

As is readily apparent from an examination of FIGS. 1, 2, 3 and 6, the shaft protector portion 24/38 extends several inches below the open bottom end of the head enclosing portion consisting of the upper part of the shaft protector portion 24 and the padded, high-pile member 20. A pair of mating hook and loop fasteners, which may be VELCRO® hook and loop portions 30 and 32, are sewn on the opposite elongated edges of the main material 24 of the shaft protector portion, as illustrated in FIGS. 2 and 6. These VELCRO® strips, along with the additional bulk provided by the fabric pile cushion portion 38, cause the elongated trapezoidal or rectangular shaft protector assembly 24/38 to be relatively rigid, while at the same time exhibiting sufficient flexibility to permit wrapping of the shaft protector portion 24/38 around the shaft 16 of a golf club, as illustrated in FIGS. 1 and 4.

The general construction of the assembly which is shown in FIGS. 1 through 6 is in accordance with the overall construction techniques employed in the manufacture of the golf club head and shaft cover of U.S. Pat. No. 5,284,194., The primary difference, however, is that the shaft protector portion 24/38 is not sewn inside a completed circular cushioned top part, but instead extends all of the way to the top 22 (as seen most clearly in FIG. 3) to provide an unbroken surface from the top 22 to the bottom of the shaft protector 24, as illustrated most clearly in FIG. 3. The padded interior surface for enclosing the head is provided by the interior of the portion 20 and the inside surface 38 on the upper portion of the shaft protector part 24/38, as seen most clearly in FIGS. 2 and 5.

Figure 3:
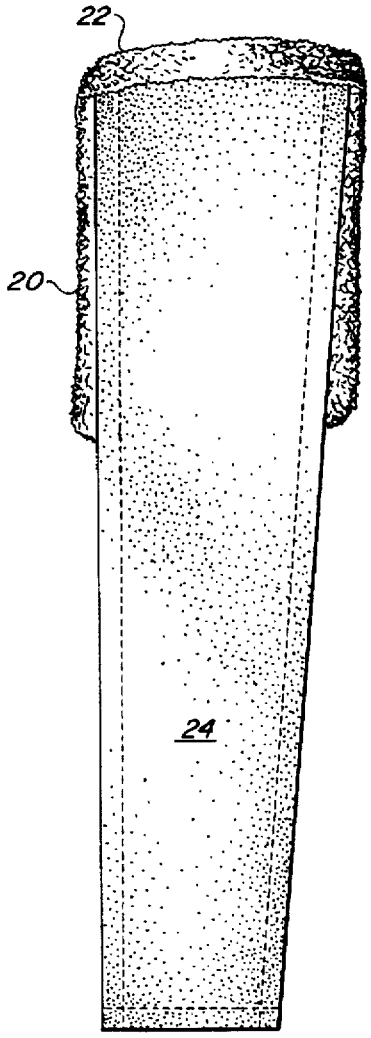
FIG. 3 is a back view of the device shown in FIG. 2.
Figure 4:
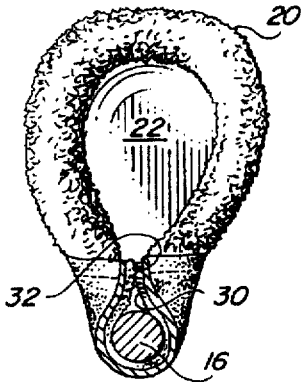
FIG. 4 is a cross-sectional view taken along the line 4—4 of FIG. 1.

By employing the shaft protector portion 24 as in an integral part of the head-enclosing part of the assembly, the unbroken surface shown in FIG. 3 then is available for embroidery of logos, designs, advertising, as desired. In addition, since the surface 24 generally is a relatively smooth surface, such as leather or nylon or similar material, detailed embroidery designs readily may be effected without the loss of detail, which may occur when embroidery designs are placed in the thick pile of the bulky material 20.

Figure 5:
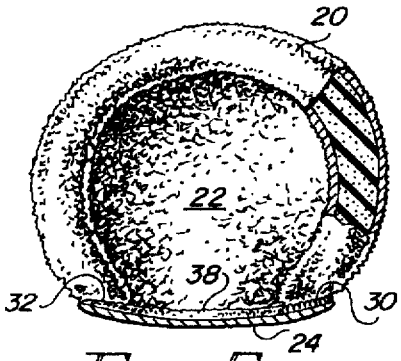
FIG. 5 is a cross-sectional view taken along the line 5—5 of FIG. 2.

When the device is to be used to cover the head of a golf club and the upper portion of the shaft, the head first is inserted into the open bottom of the device, which is in its normal or opened position as shown in FIGS. 2, 3 and 5. Once the head is inserted into the portion 20 to rest against the inside of the top 22, the opposite sides or edges of the elongated shaft protector portion 24/38 are squeezed together around the shaft 16 and closed simply by sliding the hand downwardly from the head cover portion 20, along the shaft, to engage the hook and loop fastener portions 30 and 32. This results in the shaft protector portion 24/38 being fully closed around the shaft 16, as illustrated in FIGS. 1 and 4. When the shaft protector 24/38 is fully closed, it assumes a sleek uniform configuration all the way to its lower end, fully surrounding the golf club shaft 16. The upper end, however, which is attached to the head cover part 20, maintains the relative spacing or distance between the edges, substantially as illustrated in FIGS. 2 and 3.

To remove a golf club from the device shown in FIGS. 1 and 4, all that is necessary is pull downwardly on the shaft 16 while holding the head cover 20/22/24 with the other hand. The golf club head then peels apart the hook and loop fasteners 30, 32 to open the shaft protector portion 24/38 fully, for removal of the golf club and shaft. Alternatively, the shaft protector may be opened to remove a golf club simply by sliding a finger down the hook and loop fastener 30,32 from the open portion at the top, shown most clearly in FIG. 1, between the shaft opening and the shaft 16. After this is done, the golf club head easily may be slid out of the top head cover portion 20/22. Either of these methods, however, is clearly superior to the prior art sock devices, or a device where a rigid hollow cylinder is placed around the shaft, which requires the entire length of the shaft to be pulled upwardly out of the cylinder.

It also should be noted that by utilization of the structure shown in FIGS. 1 through 6, placement of a head inside the upper portion or head cover portion 20/22 easily is effected by sliding the heel of the head along the surface 38 on the interior of the shaft protector portion 24 at the upper end, where the protector 24/38 is attached to the edges of the semi-cylindrical padded head protector portion 20.

FIGS. 7, 8, 9 and 10 illustrate an alternative embodiment of the invention. In the embodiment shown in these figures, the upper or head protector portion comprises a full cylindrical head cover portion 20, with the two edges of a generally rectangular shaped piece of material sewed together at a seam 40, as shown most clearly in FIGS. 7 and 8. The top 22 then is secured to the portion 20 in the same manner as with the embodiment of FIGS. 1 through 6. This may be done by any suitable technique, such as sewing or the like.

Figure 8:
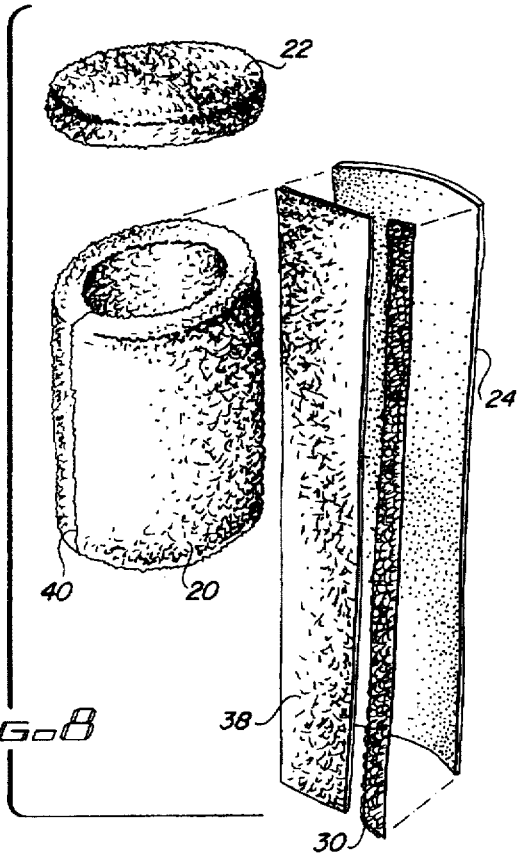
FIG. 8 is an exploded view of the embodiment shown in FIG. 7.
Figure 7:
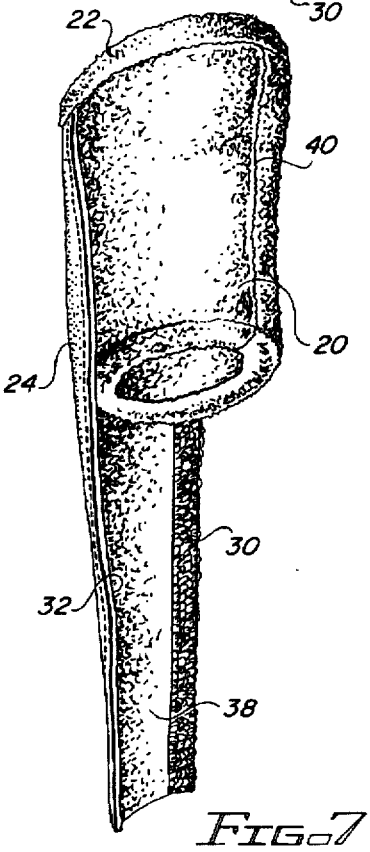
FIG. 7 is an alternate embodiment of the invention.
Figure 9:
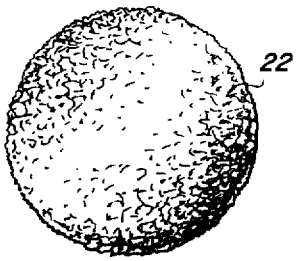
FIG. 9 is a top view of the embodiment shown in FIGS. 2 and 7.
Figure 10:
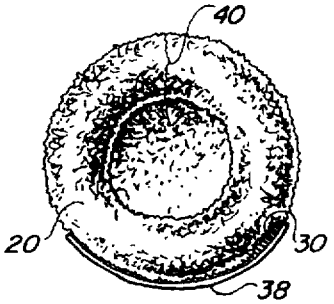
FIG. 10 is a bottom view of the embodiment shown in FIG. 7.

In the embodiment shown in FIGS. 7 and 8, however, the shaft protector portion 24/38 is sewed to the exterior of the cylindrical head cover, extending downwardly from the top 22 to a position located beneath the open bottom end of the head cover portion 20, in much the same manner as the embodiment shown in FIGS. 1 through 6. As a consequence, the relatively smooth, low pile surface on the shaft protector 24, which overlies the cylindrical padded head cover 20, may be used for embroidery design purposes in the same manner as described above in conjunction with the embodiment of FIGS. 1 through 6. In all other respects, the device of the embodiment of FIGS. 7 through 10 functions and operates in the same manner as the device of the embodiment of FIGS. 1 through 6.

The foregoing description of the preferred embodiment of the invention is to be considered as illustrative and not as limiting. For example, although a particular mating fastener has been described, other fasteners may be used if desired. Zippers, snaps, buttons or other fasteners could be used; although the hook and loop type of fastener which has been described is preferable because of its ease of use. Even so, other types of fasteners could be used if desired. Various types of materials which the desired characteristics also may be substituted to construct a device which performs substantially the same function, in substantially the same way, to achieve substantially the same result, without departing from the true scope of the invention as defined in the appended claims.

What is claimed is:

1. A golf club head cover including in combination:

a generally hollow cylindrically shaped head cover for the head of a golf club, said head cover comprising a first member of semi-cylindrical shape with first and second edges and having an upper end and a lower end, said upper end being closed and said lower end being open; and an elongated shaft protector having a predetermined length, with first and second edges and made of flexible malarial, with said first and second edges of said shaft protector secured respectively to said first and second edges of said first member and extending downwardly beyond said open lower end of said first member of said head cover a predetermined distance below said lower end of said first member, said shaft protector being normally open throughout the length thereof and including closure means thereon for closing said shaft protector around a shaft of a golf club.

2. The combination according to claim 1 wherein said elongated shaft protector has an upper end and a lower end, with the upper end thereof secured adjacent the closed end of said first member to form said generally hollow cylindrically shaped head cover for the head of a golf club, with a portion of the external and internal circumferences of said cylindrically shaped head cover comprising said upper portion of said elongated shaft protector at the upper end thereof.

3. The combination according to claim 2 wherein said closure means is located on at least one of said first and second edges of said shaft protector for closing said shaft protector around a shaft of a golf club.

4. The combination according to claim 3 wherein said closure means comprises mating closure members on said first and second edges of said elongated shaft protector.

5. The combination according to claim 4 wherein said mating closure members comprise the hook portion of a hook and loop closure on said first edge of said shaft protector and the loop portion of a hook and loop closure on said second edge of said shaft protector.

6. The combination according to claim 5 wherein said elongated shaft protector is made of material which resists movement toward said head cover on a golf club shaft.

7. The combination according to claim 6 wherein said generally elongated shaft protector is an elongated tapered member, the lower end of which is of less width than the upper end thereof.

8. The combination according to claim 1 wherein said generally elongated shaft protector is an elongated tapered member, the lower end of which is of less width than the upper end thereof.

9. The combination according to claim 1 wherein said elongated shaft protector is made of material which resists movement toward said head cover on a golf club shaft.

10. The combination according to claim 1 wherein said closure means is located on at least one of said first and second edges of said shaft protector for closing said shaft protector around a shaft of a golf club.

11. The combination according to claim 1 wherein said closure means comprises mating closure members on said first and second edges of said elongated shaft protector.

12. The combination according to claim 11 wherein said mating closure members comprise the hook portion of a hook and loop closure on said first edge of said shaft protector and the loop portion of a hook and loop closure on said second edge of said shaft protector.

13. A golf club head cover including in combination:

a generally hollow cylindrically shaped head cover for the head of a golf club, said head cover comprising a first portion having an upper end and a lower end, said upper end being closed and said lower end being open; and an elongated shaft protector having a predetermined length, with first and second edges and made of flexible martial, with said first and second edges of said shaft protector secured respectively to the outside of said first portion near the upper end thereof and extending downwardly beyond said open lower end of said first member of said head cover a predetermined distance below said lower end of said first member, said shaft protector being normally open throughout the length thereof and including closure means thereon for closing said shaft protector around a shaft of a golf club.

14. The combination according to claim 13 wherein said closure means is located on at least one of said first and second edges of said shaft protector for closing said shaft protector around a shaft of a golf club.

15. The combination according to claim 14 wherein said closure means comprises mating closure members on said first and second edges of said elongated shaft protector.

16. The combination according to claim 15 wherein said mating closure members comprise the hook portion of a hook and loop closure on said first edge of said shaft protector and the loop portion of a hook and loop closure on said second edge of said shaft protector.

17. The combination according to claim 13 wherein said generally elongated shaft protector is an elongated tapered member, the lower end of which is of less width than the upper end thereof.

18. The combination according to claim 13 wherein said elongated shaft protector is made of material which resists movement toward said head cover on a golf club shaft.

* * * * *